US012410535B2

(12) United States Patent
Kanda et al.

(10) Patent No.: US 12,410,535 B2
(45) Date of Patent: Sep. 9, 2025

(54) ANODE HOLDER, AND PLATING APPARATUS

(71) Applicant: EBARA CORPORATION, Tokyo (JP)

(72) Inventors: Hiroyuki Kanda, Tokyo (JP); Hironari Ikeda, Tokyo (JP); Masaaki Kimura, Tokyo (JP); Mizuki Nagai, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 726 days.

(21) Appl. No.: 17/616,811

(22) PCT Filed: May 28, 2020

(86) PCT No.: PCT/JP2020/021060

§ 371 (c)(1),
(2) Date: Dec. 6, 2021

(87) PCT Pub. No.: WO2020/250696

PCT Pub. Date: Dec. 17, 2020

(65) Prior Publication Data

US 2022/0307153 A1 Sep. 29, 2022

(30) Foreign Application Priority Data

Jun. 10, 2019 (JP) ..... 2019-107724

(51) Int. Cl.

| | |
|---|---|
| ***C25D 17/00*** | (2006.01) |
| ***C25D 17/02*** | (2006.01) |
| ***C25D 17/10*** | (2006.01) |

(52) U.S. Cl.

CPC ..... *C25D 17/002* (2013.01); *C25D 17/001* (2013.01); *C25D 17/02* (2013.01); *C25D 17/10* (2013.01); *C25D 17/008* (2013.01)

(58) Field of Classification Search

CPC ..... C25D 7/12; C25D 17/001; C25D 17/002; C25D 17/008

See application file for complete search history.

(56) References Cited

U.S. PATENT DOCUMENTS

| | | | |
|---|---|---|---|
| RE45,687 | E | 9/2015 | Saito et al. |
| 2005/0056538 | A1 | 3/2005 | Kovarsky et al. |

(Continued)

FOREIGN PATENT DOCUMENTS

| | | | |
|---|---|---|---|
| JP | 2510422 | B2 | 6/1996 |
| JP | 2002-275693 | A | 9/2002 |

(Continued)

OTHER PUBLICATIONS

International Patent Application No. PCT/JP2020/021060; Int'l Search Report; dated Aug. 25, 2020; 2 pages.

*Primary Examiner* — Ciel P Contreras
(74) *Attorney, Agent, or Firm* — BakerHostetler

(57) ABSTRACT

Provided are an anode holder capable of reducing consumption of an additive in a plating apparatus, and a plating apparatus. An anode holder for holding an anode for use in a plating apparatus is provided, and the anode holder includes an inner space formed in the anode holder, to house the anode, a mask including a plurality of holes, and configured to cover a front surface of the inner space, and a diaphragm, at least part of the diaphragm being fixed to the mask in a region of the mask that covers the front surface of the inner space.

10 Claims, 12 Drawing Sheets

(56) References Cited

U.S. PATENT DOCUMENTS

| | | | | |
|---|---|---|---|---|
| 2014/0151218 | A1* | 6/2014 | Woodruff | C25D 17/001 204/279 |
| 2015/0129418 | A1* | 5/2015 | Keigler | C25D 21/10 204/237 |
| 2016/0369421 | A1 | 12/2016 | Yahagi et al. | |
| 2018/0239242 | A1* | 8/2018 | Kohmura | G03F 1/62 |

FOREIGN PATENT DOCUMENTS

| | | | | | |
|---|---|---|---|---|---|
| JP | 2007-505996 | A | | 3/2007 | |
| JP | 2008-038208 | A | | 2/2008 | |
| JP | 2009-155726 | A | | 7/2009 | |
| JP | 2015-151553 | A | | 8/2015 | |
| KR | 20170057217 | A | * | 5/2017 | C25D 17/02 |

* cited by examiner

ANODE HOLDER, AND PLATING APPARATUS

TECHNICAL FIELD

The present invention relates to an anode holder and a plating apparatus.

BACKGROUND ART

Heretofore, a wiring has been formed in a fine wiring groove, hole or resist opening provided in a surface of a semiconductor wafer or the like, and a bump (a protruding electrode) to be electrically connected to an electrode of a package or the like has been formed on the surface of the semiconductor wafer or the like. As a method of forming this wiring and bump, for example, an electroplating method, an evaporation method, a printing method, a ball bump method or the like is known, but with increase in an I/O number of semiconductor chips and for a finer pitch, the electroplating method is becoming often used in which miniaturization is possible and performance is relatively stable.

A plating apparatus for use in the electroplating method includes a substrate holder holding a substrate of a semiconductor wafer or the like, an anode holder holding an anode, and a plating solution tank that stores a plating solution containing a large number of types of additives. When a substrate surface of the semiconductor wafer or the like is plated in this plating apparatus, the substrate holder is disposed to face the anode holder in the plating solution tank. In this state, the substrate and the anode are energized, and accordingly a plating film is formed on the substrate surface. In addition, the additive has an effect of accelerating or suppressing a film formation speed of the plating film, an effect of improving film quality of the plating film, and the like.

Heretofore, a soluble anode that dissolves in the plating solution or an insoluble anode that does not dissolve in the plating solution has been used as the anode to be held by the anode holder. In a case where the plating is performed by using the insoluble anode, oxygen is generated by reaction between the anode and the plating solution. The additive in the plating solution reacts with this oxygen and is decomposed. There is a problem that, when the additive is decomposed, the additive loses the above-described effects, and a desired film cannot be obtained on the substrate surface (e.g., see PTL 1). It is also known that, in a case w % here, for example, phosphorus-containing copper is used as the soluble anode, deterioration of the additive, especially an accelerator, occurs due to reaction with monovalent copper generated from the anode when electrolysis is not performed. To prevent this problem, the additive may be added to the plating solution as required to keep concentration of the additive in the plating solution in a predetermined concentration or more. However, the additive is expensive, and hence it is desirable to inhibit the decomposition of the additive as much as possible.

Consequently, it has been suggested that an interior of the plating solution tank is divided, by a diaphragm, into a space in which the anode is disposed (an anode tank) and a space in which the substrate and a cathode are arranged (a cathode tank), to inhibit the additive in the plating solution from reaching the anode and suppress decomposition of the additive (e.g., see PTL 2).

CITATION LIST

Patent Literature

PTL 1: Japanese Patent No. 2510422
PTL 2: Japanese Patent Laid-Open No. 2009-155726

SUMMARY OF INVENTION

Technical Problem

As described above, by a diaphragm including a fine hole with a size smaller than an average size of a molecule included in an additive, an additive included in a plating solution in a cathode tank is inhibited from being moved into an anode tank, and decomposition of the additive is suppressed. Heretofore, the diaphragm has been disposed to cover an opening in an anode holder, an anode box, or a regulation plate. However, according to investigation by the present inventors, it has been found that in a conventional configuration, a region where the diaphragm acts on the plating solution in the cathode tank is wide, the additive is therefore consumed, and there is room for improvement.

The present invention has been developed in view of the above problems, and one of objects thereof is to provide an anode holder capable of reducing consumption of an additive in a plating apparatus, and a plating apparatus.

Solution to Problem

According to an embodiment of the present invention, an anode holder for holding an anode for use in a plating apparatus is provided, and the anode holder includes an inner space formed in the anode holder, to house the anode, a mask including a plurality of holes, and configured to cover a front surface of the inner space, and a diaphragm, at least part of the diaphragm being fixed to the mask in a region of the mask that covers the front surface of the inner space. According to this anode holder, the mask can reduce a region where the diaphragm is in contact with a plating solution, and can further inhibit the additive from reaching the anode to reduce consumption of the additive.

According to another embodiment of the present invention, a plating apparatus is provided, and the plating apparatus includes a plating solution tank, a mask including a plurality of holes, and dividing the plating solution tank into an anode tank in which an anode is disposed and a cathode tank in which a cathode is disposed, and a diaphragm, at least part of the diaphragm being fixed to the mask in a region of the mask that covers a front surface of an inner space. According to this plating apparatus, the mask can reduce a region where the diaphragm is in contact with a plating solution, and can further inhibit an additive from reaching the anode to reduce consumption of the additive.

DESCRIPTION OF EMBODIMENTS

Hereinafter, embodiments of a plating apparatus and an anode holder according to the present invention will be described with reference to the accompanying drawings. In the accompanying drawings, the same or similar element is denoted with the same or similar reference sign, and in descriptions of the respective embodiments, a description concerning the same or similar element may not be repeated. Also, characteristics illustrated in the respective embodiments are also applicable to another embodiment as long as the characteristics of the embodiments are not contradictory to each other.

First Embodiment

Figure 1:
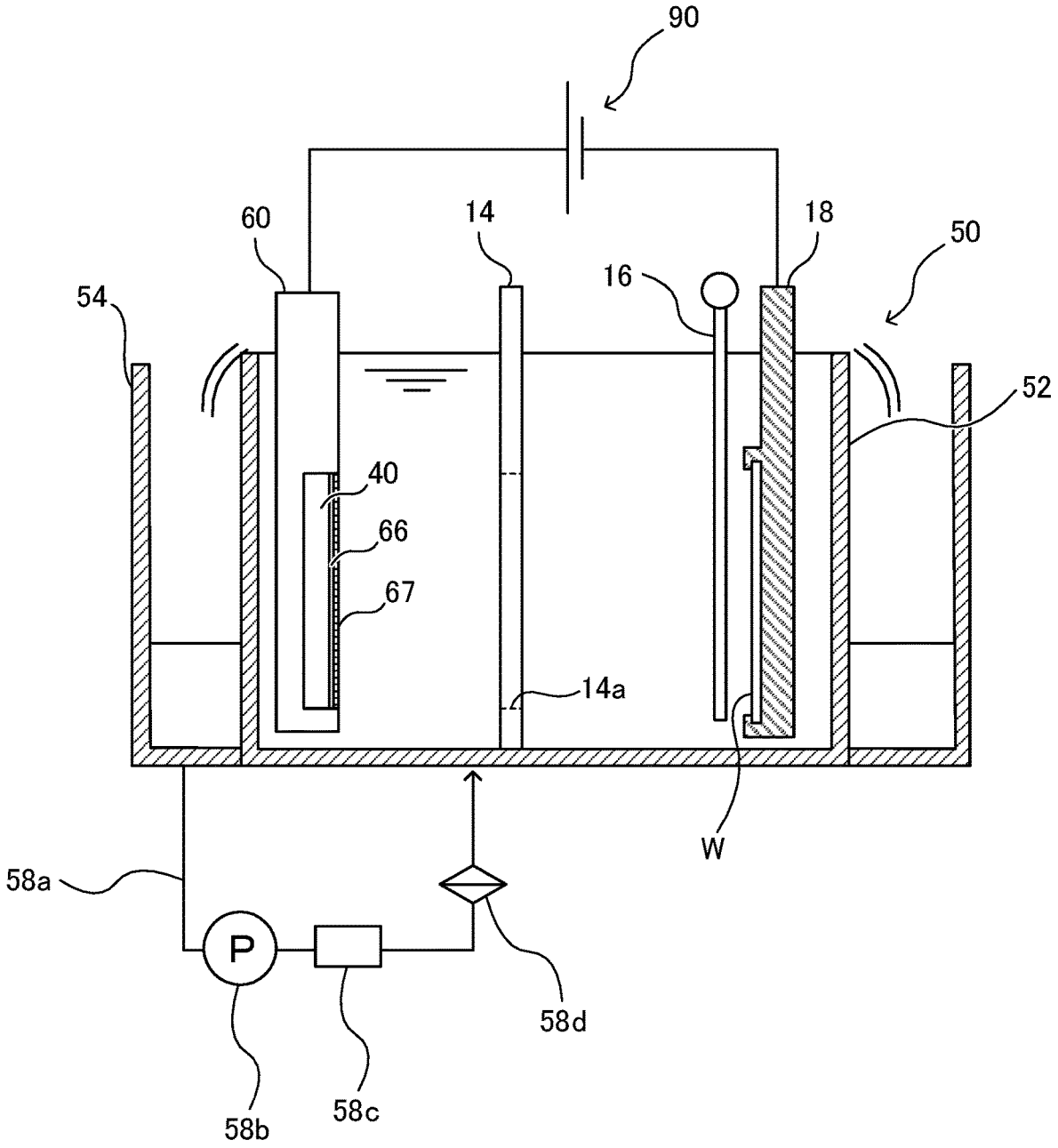
FIG. 1 is a schematic view showing a plating apparatus according to a first embodiment.

FIG. 1 is a schematic view showing a plating apparatus according to a first embodiment. As shown in FIG. 1, the plating apparatus includes a plating solution tank 50 holding a plating solution inside, an anode 40 disposed in the plating solution tank 50, an anode holder 60 holding the anode 40, and a substrate holder 18. The substrate holder 18 removably holds a substrate W such as a wafer, and is configured to immerse the substrate W into the plating solution in the plating solution tank 50. The plating apparatus according to the present embodiment is an electroplating apparatus that applies current through the plating solution to plate a surface of the substrate W with a metal.

The substrate W is, for example, a semiconductor substrate, a glass substrate, or a resin substrate. The metal with which the surface of the substrate W is plated is, for example, copper (Cu), nickel (Ni), tin (Sn), Sn—Ag alloy, or cobalt (Co).

The anode 40 and the substrate W are arranged to extend in a vertical direction, that is, so that plate surfaces of the anode 40 and the substrate W face in a horizontal direction and face each other in the plating solution. The anode 40 is connected to a positive electrode of a power source 90 via the anode holder 60, and the substrate W is connected to a negative electrode of the power source 90 via the substrate holder 18. When a voltage is applied between the anode 40 and the substrate W, current flows to the substrate W, and a metal film is formed on the surface of the substrate W in the presence of the plating solution.

The plating solution tank 50 includes a plating solution storage tank 52 in which the substrate W and the anode 40 are arranged, and an overflow tank 54 disposed adjacent to the plating solution storage tank 52. The plating solution in the plating solution storage tank 52 flows over a side wall of the plating solution storage tank 52 to flow into the overflow tank 54.

One end of a plating solution circulation line 58*a* is connected to a bottom of the overflow tank 54, and the other end of the plating solution circulation line 58*a* is connected to a bottom of the plating solution storage tank 52. A circulation pump 58*b*, a constant temperature unit 58*c* and a filter 58*d* are attached to the plating solution circulation line 58*a*. The plating solution flows over the side wall of the plating solution storage tank 52 to flow into the overflow tank 54, and further flows from the overflow tank 54 through the plating solution circulation line 58*a* to return to the plating solution storage tank 52. Thus, the plating solution circulates between the plating solution storage tank 52 and the overflow tank 54 through the plating solution circulation line 58*a*.

The plating apparatus further includes a regulation plate 14 that regulates a potential distribution on the substrate W, and a paddle 16 that stirs the plating solution in the plating solution storage tank 52. The regulation plate 14 is disposed between the paddle 16 and the anode 40, and includes an opening 14*a* for limiting an electric field in the plating solution. The paddle 16 is disposed in the vicinity of the surface of the substrate W held by the substrate holder 18 in the plating solution storage tank 52. The paddle 16 is made of, for example, titanium (Ti) or resin. The paddle 16 reciprocates in parallel with the surface of the substrate W, to stir the plating solution so that metal ions are sufficiently and uniformly supplied to the surface of the substrate W during the plating of the substrate W.

Figure 2:
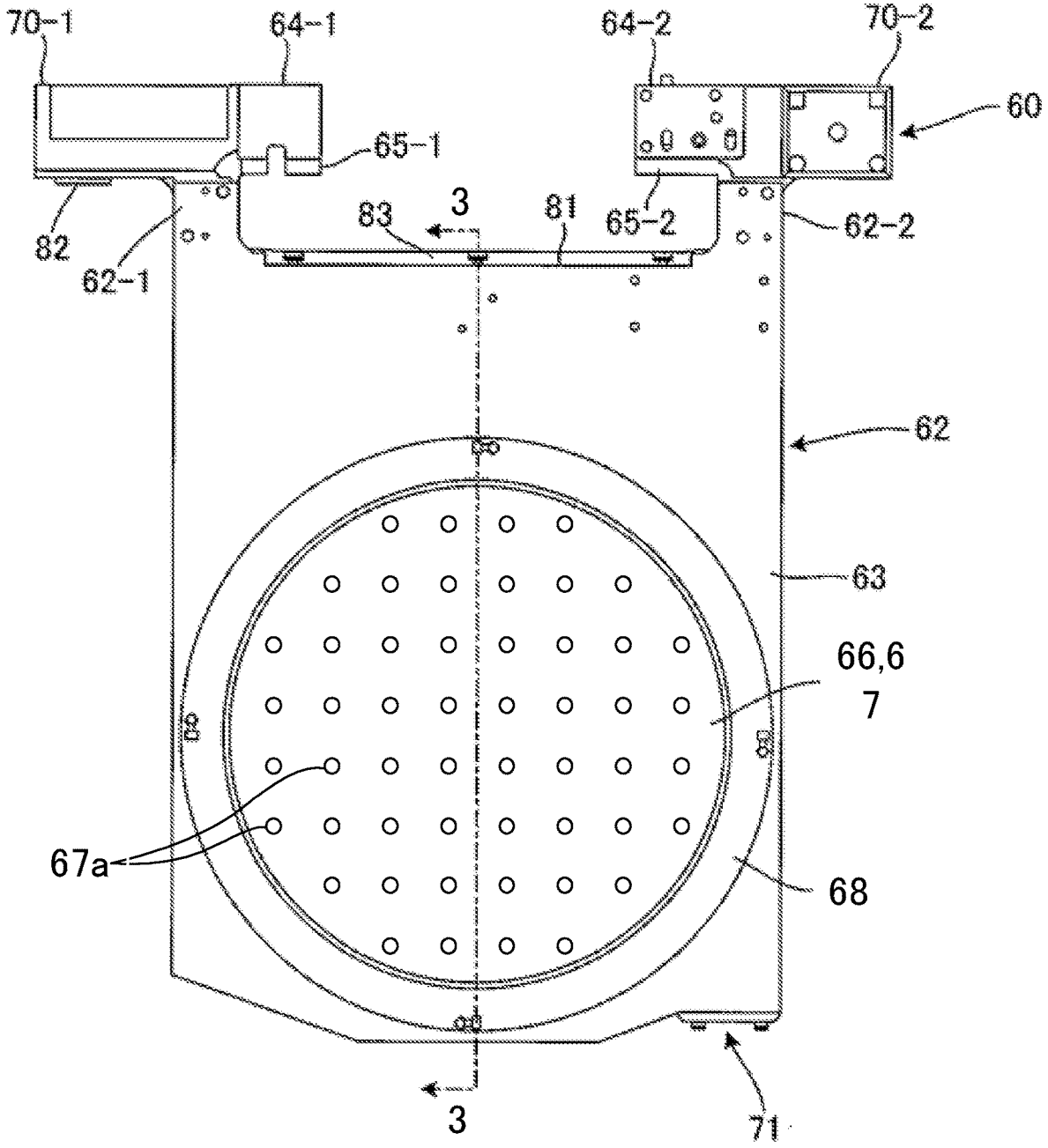
FIG. 2 is a plan view of an anode holder according to the present embodiment.
Figure 3:
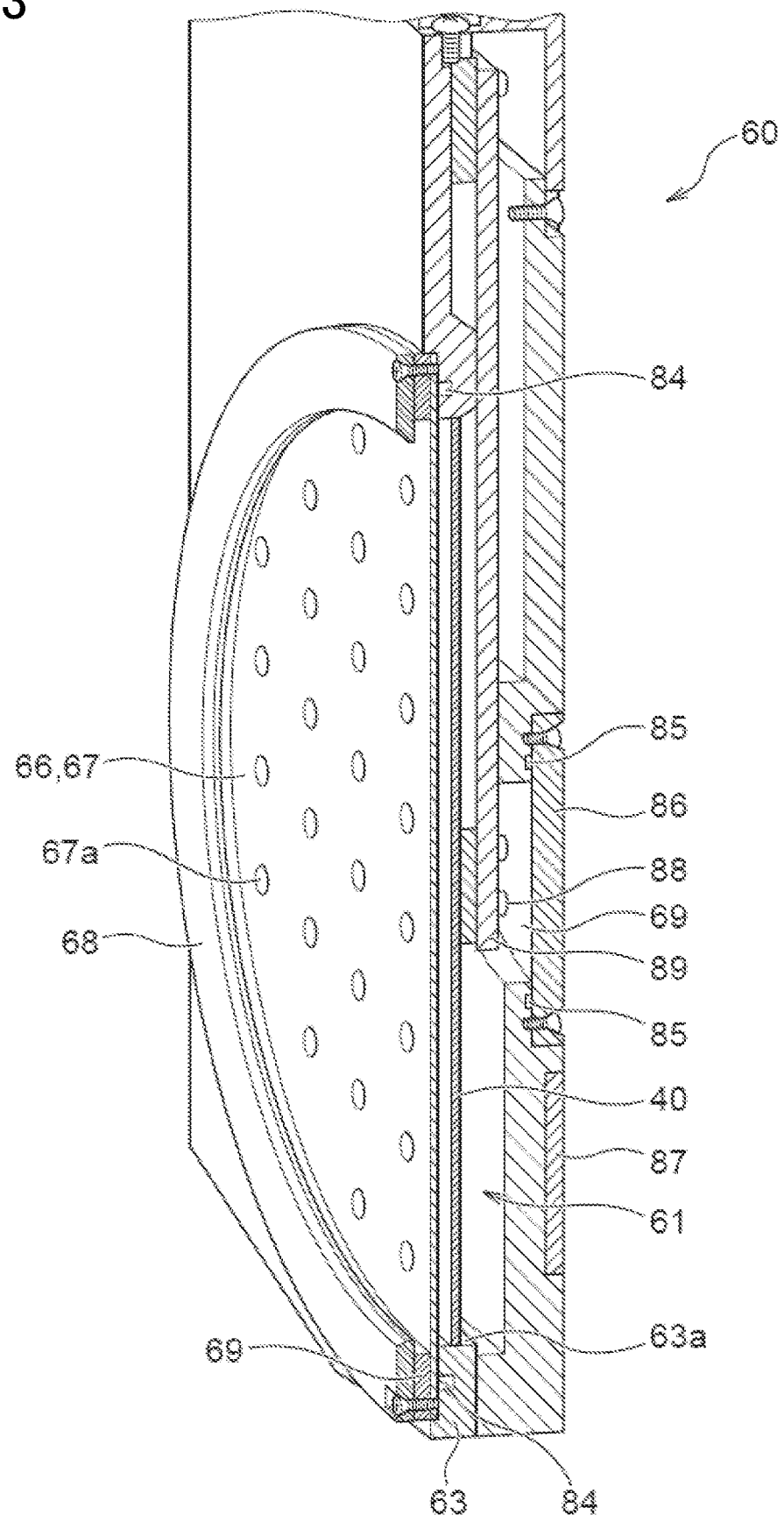
FIG. 3 is a side cross-sectional view of an anode holder 60 taken along the 3-3 line shown in FIG. 2.
Figure 4:
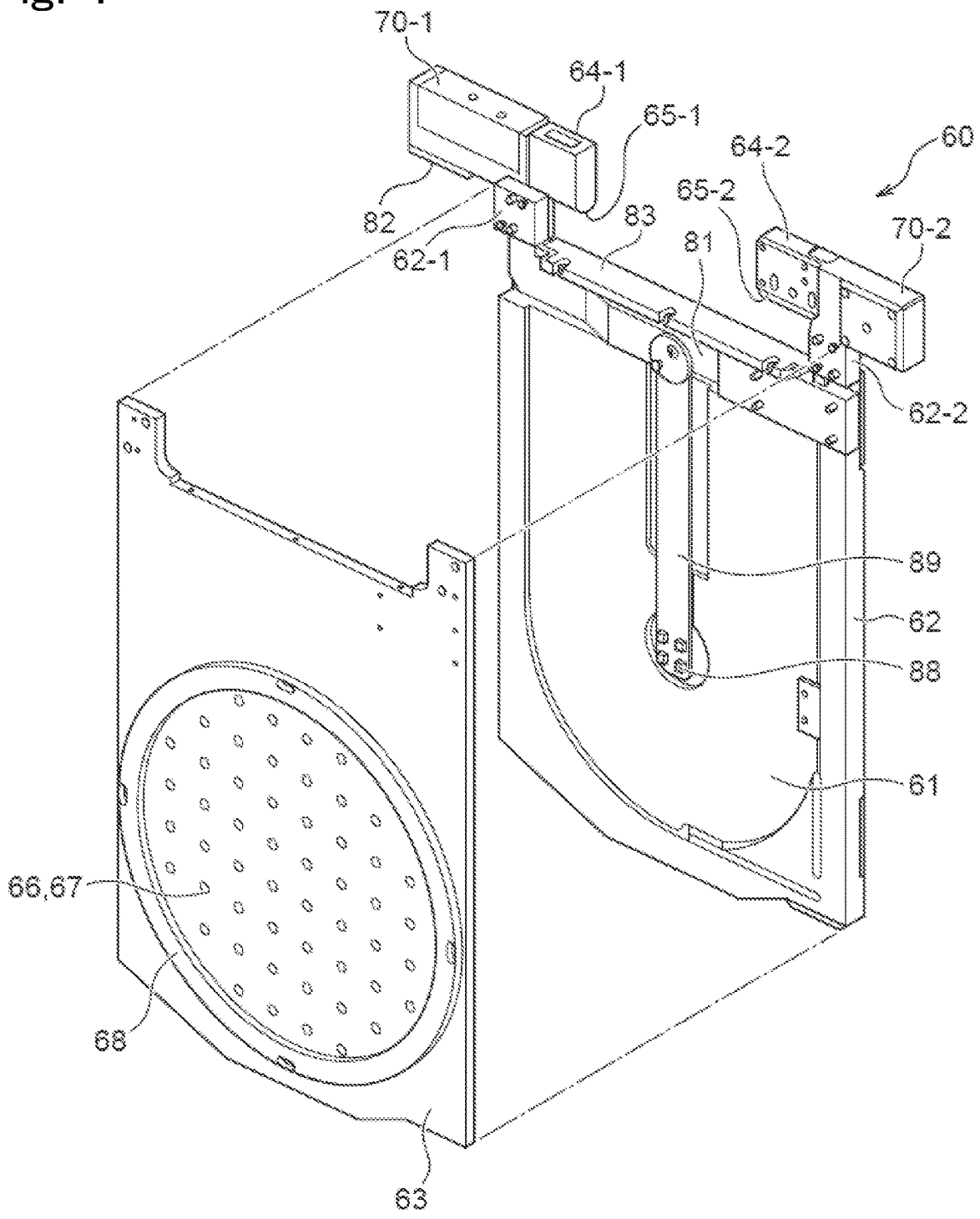
FIG. 4 is an exploded perspective view of the anode holder in a state where a holder base cover is removed.
Figure 5:
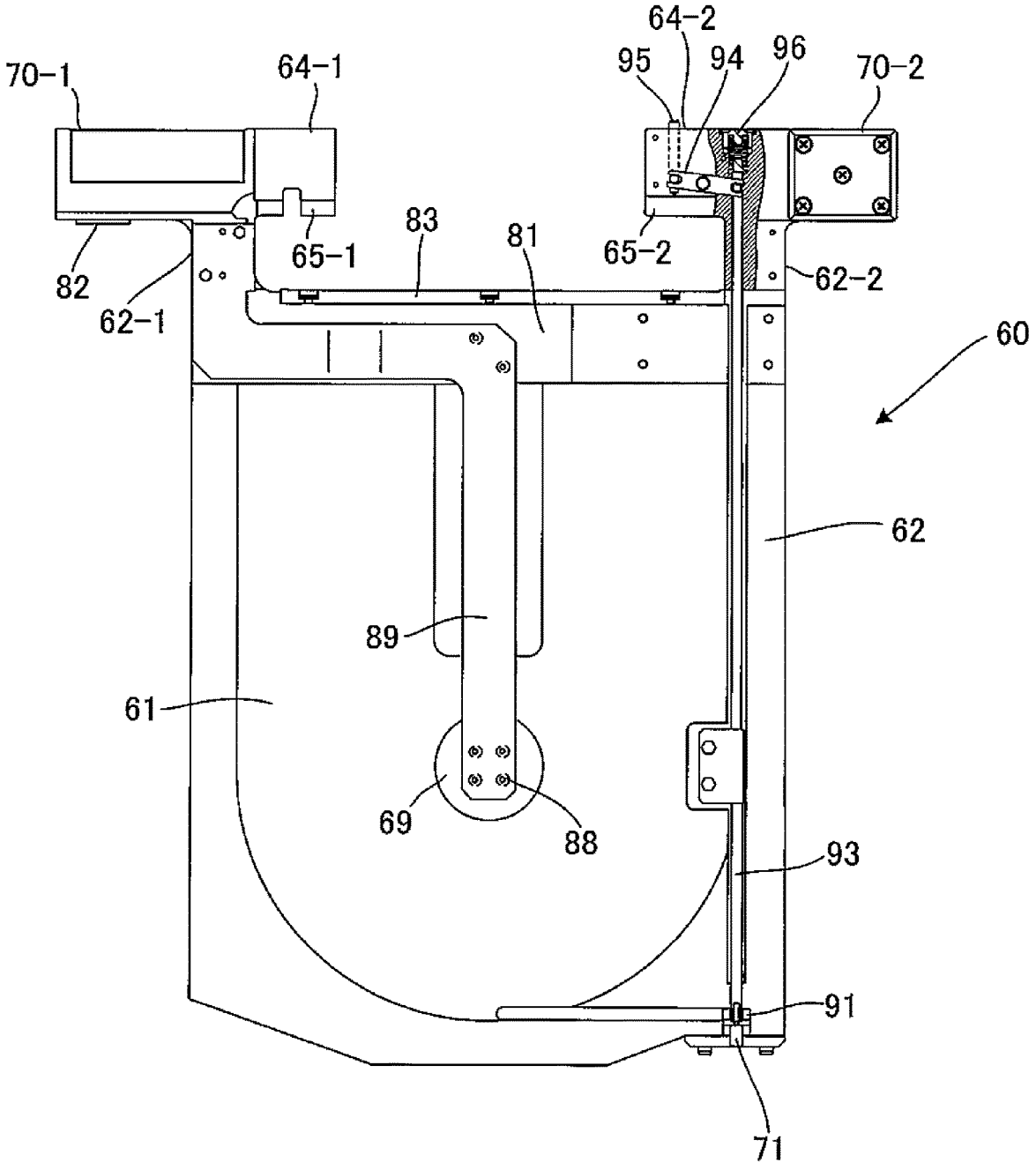
FIG. 5 is a plan view of the anode holder in the state where the holder base cover is removed.

FIG. 2 is a plan view of the anode holder 60, FIG. 3 is aside cross-sectional view of the anode holder 60 taken along the 3-3 line shown in FIG. 2, FIG. 4 is an exploded perspective view of the anode holder 60 in a state where a holder base cover 63 is removed, and FIG. 5 is a plan view of the anode holder 60 in the state where the holder base cover 63 is removed. Note that FIG. 5 shows, for convenience, the anode holder 60 in a state where a grip 64-2 is transparent. Furthermore, FIGS. 4 and 5 show, for convenience, the anode holder 60 in a state where the anode 40 is removed. Further, in the present description, "up" and "down" refer to an upward direction and a downward direction in a state where the anode holder 60 is vertically housed in the plating solution tank 50. Similarly, in the present description, "a front surface" refers to a surface on a side on which the anode holder 60 faces the substrate holder, and "a back surface" refers to a surface on a side opposite to the front surface.

As shown in FIGS. 2 to 4, the anode holder 60 according to the present embodiment includes a substantially rectangular holder base 62 including an inner space 61 that houses the anode 40, a pair of grips 64-1 and 64-2 formed in an upper part of the holder base 62, and a pair of arms 70-1 and 70-2 similarly formed in the upper part of the holder base 62. Also, the anode holder 60 includes the holder base cover 63 that partially covers a front surface of the holder base 62, a diaphragm 66 disposed on a front surface of the holder base cover 63 to cover the inner space 61, a mask 67 including a plurality of holes 67*a* and fixed to the diaphragm 66, and an outer edge mask 68 disposed on front surfaces of the diaphragm 66 and the mask 67. Additionally, in the present embodiment, the holder base cover 63 supporting the diaphragm 66 and the mask 67 corresponds to "a base body".

As shown in FIGS. 2 and 5, the holder base 62 includes a hole 71 extending from an outer surface of a lower part to the inner space 61 of the holder base, and communicating with the inner space 61. Also, the holder base 62 includes an air outlet 81 for exhausting air of the inner space 61, between the grips 64-1 and 64-2 in the upper part of the holder base. When the holder base 62 is immersed into the plating solution, the plating solution flows through the hole 71 into the inner space 61, and air of the inner space 61 is exhausted from the air outlet 81. Furthermore, in a case where the insoluble anode is used as the anode 40, oxygen generated from the anode 40 during the plating is also exhausted through the air outlet 81. The air outlet 81 is closed with a lid 83 formed so that the exhaust of air is not obstructed.

Also, as shown in FIG. 3, an annular opening 63*a* having a diameter larger than a diameter of the anode 40 is formed in a substantially central portion of the holder base cover (base body) 63. The holder base cover 63 forms the inner space 61 together with the holder base 62. The diaphragm 66 is disposed on a front surface of the opening 63*a*, to close the inner space 61. In the present embodiment, the mask 67 including the plurality of holes 67*a* is fixed to one plate surface of the diaphragm 66. A diaphragm retainer 69 is attached in front of outer peripheral edges of the diaphragm 66 and the mask 67, and the outer edge mask 68 is disposed in front of the diaphragm retainer 69. Also, an annular first sealing member 84 including, for example, an O-ring or the like is disposed along the opening 63*a* in the front surface of the holder base cover 63. The diaphragm 66 and the mask 67 are pressed onto the first sealing member 84 by the diaphragm retainer 69, to tightly close the opening 63*a*. That is, the first sealing member 84 can tightly close between the diaphragm 66 and the inner space 61. Consequently, the inner space 61 and the outer space are divided by the diaphragm 66 and the mask 67.

The diaphragm 66 is, for example, an ion exchange membrane such as a cation exchange membrane, or a neutral diaphragm. During plating, cations can pass through the diaphragm 66 from an anode side to a cathode side while any additive in the plating solution does not pass. A specific example of the diaphragm 66 is YUMICRON (registered trademark) manufactured by Yuasa Membrane Systems Co., Ltd.

The mask 67 is a plate-shaped member including the plurality of holes 67*a*, and is disposed to reduce a region where the diaphragm 66 is in contact with the plating solution. The mask 67 has a plate thickness of, for example, about 1 mm. The mask 67 is made of a resin such as polypropylene (PP) or polyvinyl chloride (PVC), a metal such as titanium (Ti) or the like. The mask 67 is fixed to the plate surface of the diaphragm 66. In an example shown in FIGS. 2 to 5, the mask 67 is fixed to a front of the diaphragm 66, that is, on an outer space side (side opposite to the inner space 61) of the diaphragm 66. However, the present invention is not limited to this example, and the mask 67 may be fixed to a rear of the diaphragm 66, that is, on an inner space 61 side of the diaphragm 66, and may be fixed to both the front and the rear of the diaphragm 66.

In the mask 67, the plurality of holes 67*a* are formed. In each of the plurality of holes 67*a*, for example, a maximum distance from one end to the other end (an inner diameter in a case where the plurality of holes 67*a* each have a circular shape) is preferably 10 mm or less, especially preferably 8 mm or less, 5 mm or less, 3 mm or less, or 2 mm or less. Also, it is preferable that each of the plurality of holes 67*a* has the circular shape, but may have an elliptic shape, a polygonal shape or the like. Furthermore, in the example shown in FIGS. 2 to 5, each of the plurality of holes 67*a* has the same size, but the present invention is not limited to this example. For example, the plurality of holes 67*a* may have a size increasing closer to a center of the anode 40, and decreasing away from the center of the anode 40, and conversely, the holes may have a size decreasing closer to the center of the anode 40, and increasing away from the center of the anode 40. Also, in the example shown in FIGS. 2 to 5, the plurality of holes 67*a* are provided at equal intervals in a biaxial direction in a plate surface of the mask 67, but the present invention is not limited to this example. For example, the plurality of holes 67*a* may be arranged with a distance between the holes decreasing closer to the center of the anode 40 and increasing away from the center of the anode 40, and conversely the holes may be arranged with the distance between the holes increasing closer to the center of the anode 40 and decreasing away from the center of the anode 40. Furthermore, the plurality of holes 67*a* may be radially arranged.

Also, in the plurality of holes 67*a*, it is preferable that an opening ratio is equal to or more than 2% and equal to or less than 25%, and it is especially preferable that the opening ratio is equal to or more than 3%, equal to or more than 5%, equal to or less than 10%, or equal to or less than 12.5%. This is based on the fact that, if the opening ratio is large, the contact region of the diaphragm 66 with the plating solution is large, an effect of reducing consumption of an additive accordingly decreases, and it is difficult to sufficiently fix the diaphragm 66 and the mask 67. This is also based on the fact that, if the opening ratio is small, it is difficult to remove gas (bubble) from the holes 67*a*, and passage of cations from the anode side to the cathode side through the diaphragm 66 runs short. In the present embodiment, the plurality of holes 67*a* are substantially uniformly arranged, and the opening ratio due to the plurality of holes 67*a* is 6%. However, the present invention is not limited to this example. For example, the mask 67 may be formed with the opening ratio decreasing closer to the center of the anode 40 and increasing away from the center of the anode 40, and conversely, the mask may be formed with the opening ratio increasing closer to the center of the anode 40 and decreasing away from the center of the anode 40.

Further, the plurality of holes 67*a* may be formed with the same diameter in a front-rear direction, or may be formed to be tapered. It is especially preferable that the plurality of holes 67*a* of the mask 67 may be formed to be tapered with a diameter decreasing closer to the diaphragm 66 and increasing away from the diaphragm 66. In this case, foreign matter such as gas or bubbles can be inhibited from staying in the holes 67*a*.

The mask 67 is fixed to the diaphragm 66. In other words, the diaphragm 66 is fixed to the mask 67. At least part of the diaphragm 66 is fixed to the mask 67 in a region of the mask 67 that covers a front surface of the inner space 61, that is, a region of the mask that covers the opening 63*a* of the holder base cover 63. However, the diaphragm 66 and the mask 67 may be fixed to each other also in a region other than the region that covers the front surface of the inner space 61. In addition, it may be also considered that the mask 67 is "secured" to the diaphragm 66.

In the present embodiment, the mask 67 is attached to the diaphragm 66 by welding. However, a method of fixing the mask 67 to the diaphragm 66 is not limited to the welding. For example, the diaphragm 66 and the mask 67 may be non-removably welded, pressed or bonded (hereinafter, referred to together as "closely connected") via a closely connecting layer. Specifically, the diaphragm 66 and the mask 67 may be closely connected to each other by heat welding with a sealer or the like, laser welding, ultrasonic welding, or vibration welding. Alternatively, the diaphragm 66 and the mask 67 may be closely connected to each other by using a pouch processing technology, a laminate processing technology, or an adhesive such as vinyl chloride. In the pouch processing technology and the laminate processing technology, attaching a sheet material such as a PET material at high temperature and high pressure, attaching sheet materials such as PET materials to each other by plasma treatment, or extruded lamination by use of the sheet material such as a PET material may be adopted. Alternatively, as the adhesive, TAKIBOND (registered trademark) that is an adhesive for PVC manufactured by TAKIRON Corporation, an epoxy resin adhesive for PE and PET, or a low outgas adhesive manufactured by Sunstar Engineering may be adopted.

The mask 67 and the diaphragm 66 may be non-removably closely connected in the whole region of the mask 67, or may be non-removably closely connected to be fixed to each other in part of the region. However, the plating solution enters a gap between the mask 67 and the diaphragm 66 to increase a contact region of the diaphragm 66 with the plating solution. Especially in the plating apparatus of the present embodiment, the plating solution is stirred with the paddle 16, and hence the plating solution easily enters the gap between the mask 67 and the diaphragm 66. Consequently, it is preferable that the mask 67 and the diaphragm 66 are non-removably closely connected in a wide region to reduce entrance of the plating solution into the gap.

Thus, the anode holder 60 of the present embodiment includes the mask 67 including the plurality of holes 67*a* and covering the front surface of the inner space 61, and the diaphragm 66 is disposed to be fixed to the mask 67. Consequently, the region where the diaphragm 66 is in contact with the plating solution can be smaller than that in a case where the mask 67 is not provided, and the additive can be inhibited from reaching the anode 40 to reduce the consumption of the additive.

The outer edge mask 68 is a plate-shaped member including an annular opening in a central portion of the member, and is removably mounted to a front surface of the diaphragm retainer 69. A diameter of the opening in the outer edge mask 68 is smaller than an outer diameter of the anode 40. Consequently, when the outer edge mask 68 is attached to the diaphragm retainer 69, the outer edge mask 68 is configured to cover an outer peripheral edge of the anode 40 when seen from a plane shown in FIG. 2. Consequently, the outer edge mask 68 can control an electric field on the surface of the anode 40 during the plating.

The holder base cover 63 is fixed to the holder base 62 by screw connection, welding or the like, and the holder base cover 63 is closely connected to the holder base 62. Alternatively, the holder base cover 63 may be formed integrally with the holder base 62.

As shown in FIGS. 2, 4 and 5, the grips 64-1 and 64-2 are coupled with the holder base 62 via couplings 62-1 and 62-2 formed in the upper part of the holder base 62. The grips 64-1 and 64-2 are formed to extend from the couplings 62-1 and 62-2 toward a center of the holder base 62. The grips 64-1 and 64-2 are gripped with an unshown chuck, when the anode holder 60 is conveyed to the plating solution tank 50.

An electrode terminal 82 for applying a voltage to the anode 40 is disposed in a lower part of the arm 70-1 extending outward from the couplings 62-1 and 62-2. The electrode terminal 82 is connected to the positive electrode of the power source 90, when the anode holder 60 is housed in the plating solution tank. Also, the anode holder 60 includes a power supply member 89 extending from the electrode terminal 82 to a substantially central portion of the inner space 61. The power supply member 89 is a substantially plate-shaped conductive member, and electrically connected to the electrode terminal 82.

As shown in FIG. 3, the anode 40 is fixed to a front surface of the power supply member 89 with a fixing member 88 including, for example, a screw and the like. Consequently, the voltage can be applied from the power source 90 to the anode 40 via the electrode terminal 82 and the power supply member 89.

An annular opening 62*a* for changing the anode 40 is formed in a substantially central portion of the holder base 62, that is, at a position corresponding to the fixing member 88. The opening 62*a* communicates with aback surface side of the inner space 61, and is covered with a lid 86. On a back surface side of the holder base 62, an annular second sealing member 85 including, for example, an O-ring or the like is disposed along the opening 62*a*. A gap between the opening 62*a* and the lid 86 is sealed with the second sealing member 85.

The lid 86 is removed when the anode 40 is changed. Specifically, for example, with elapse of useful life of the anode 40, an operator removes the lid 86, and removes the fixing member 88 via the opening 62*a*. The operator removes the outer edge mask 68 from the diaphragm retainer 69, and removes the anode 40 from the inner space 61. Subsequently, the operator houses another anode 40 in the inner space 61, and fixes the anode 40 to the front surface of the power supply member 89 with the fixing member 88 via the opening 62*a*. Lastly, the operator seals the opening 62*a* with the lid 86, and attaches the outer edge mask 68 to the diaphragm retainer 69.

A weight 87 is attached to a back surface of the holder base 62. Consequently, the anode holder 60 can be prevented from floating on a surface of water due to buoyancy, when the anode holder 60 is immersed into the plating solution.

As shown in FIG. 5, the anode holder 60 further includes a valve 91 configured to seal the hole 71, a spring 96 for biasing the valve 91 to close the valve 91, a shaft 93 for transmitting biasing force of the spring 96 to the valve 91, a push rod 95 as an operation member that operates the valve 91 to open and close the valve, and an intermediate member 94 for transmitting, to the shaft 93, force applied to the push rod 95.

The valve 91 is disposed in the holder base 62 so that the hole 71 can be sealed on an inner side of the holder base 62. The shaft 93 is disposed along an up-down direction in the holder base 62. The shaft 93 has one end coupled to the valve 91, and the other end coupled to the spring 96. Consequently, the shaft 93 transmits the biasing force of the spring 96 to the valve 91, and the valve 91 is biased so that the hole 71 is sealed with the valve 91 on the inner side of the holder base 62.

Thus, the anode holder 60 includes the valve 91 that seals the hole 71, so that the hole 71 can be sealed, after the anode holder 60 is immersed into the plating solution to fill the inner space 61 with the plating solution. Consequently, if oxygen, hypochlorous acid or monovalent copper is generated in the vicinity of the anode 40, proceeding of decomposition of the additive can be inhibited, because the outer space and the inner space 61 are divided. Alternatively, in the plating apparatus, the anode holder 60 may be disposed in the plating solution storage tank 52 in a state where a base liquid is put in the plating solution storage tank 52, the inner space 61 of the anode holder 60 may be filled with the base liquid and then sealed, and a liquid containing the additive may be put in the plating solution storage tank 52 to prepare the plating solution in the outer space. In this case, the inner space 61 of the anode holder 60 does not store the additive, and hence consumption of the additive in the vicinity of the anode 40 can be reduced more. However, the present invention is not limited to this example, and the anode holder 60 may be disposed in the plating solution storage tank 52 in a state where the plating solution containing the additive is put in the plating solution storage tank 52, and the inner space 61 of the anode holder 60 may be filled with the plating solution containing the additive and then sealed.

Figure 6A:
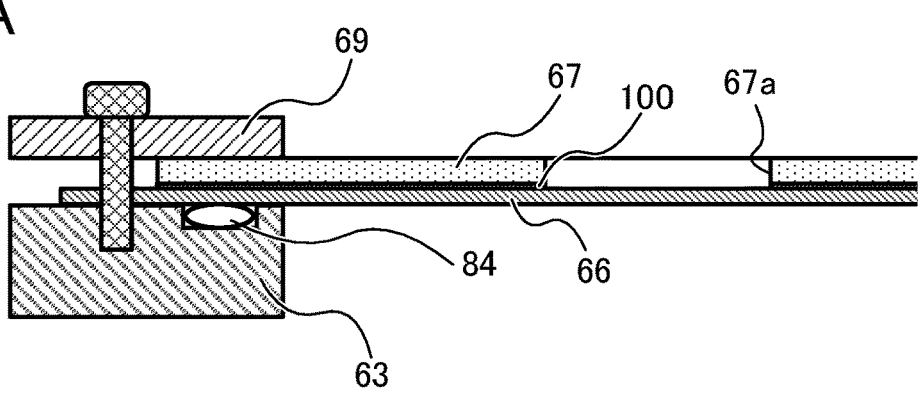
FIG. 6A is a view schematically showing a mounting structure of a diaphragm and a mask in FIG. 3.

Next, description will be made as to fixing of the diaphragm 66 and the mask 67 in the anode holder 60. FIG. 6A is a view schematically showing a mounting structure of the diaphragm 66 and the mask 67 in FIG. 3. Note that in FIG. 6A and the subsequent drawing, a closely connecting layer closely connecting the diaphragm 66 and the mask 67 is denoted with reference number 100. Further, in FIG. 6A and the subsequent drawing, the diaphragm 66 is fixed to one of a front surface or a back surface of the mask 67, but the present invention is not limited to this example, and the diaphragm may be fixed to the other of the front surface or the back surface of the mask 67. Alternatively, the diaphragms 66 may be fixed to both of the front surface and the back surface of the mask 67, and the masks 67 may be fixed to both of front and rear of the diaphragm 66, respectively.

In an example shown in FIG. 6A, both the diaphragm 66 and the mask 67 have a size larger than a size of an opening in the diaphragm retainer 69, and both the diaphragm 66 and the mask 67 are sandwiched between the diaphragm retainer 69 and the holder base cover 63, to be supported in the anode holder 60. Also, the diaphragm 66 is closely connected to the mask 67 via the closely connecting layer 100. According to this configuration, it is possible to tightly close between the anode holder 60 and the diaphragm 66 more securely, and the mask 67 can be physically sandwiched between the diaphragm 66 and the diaphragm retainer 69, to be firmly supported. In the example shown in FIG. 6A, the diaphragm 66 is closely connected to the back surface (lower side in FIG. 6) of the mask 67. Thus, the mask 67 is located in front of the diaphragm 66, and hence when oxygen is generated in the inner space 61 where the anode 40 is disposed, oxygen can be inhibited from entering the holes 67*a*, and a disadvantage that oxygen is located in the holes 67*a* to shield the electric field can be suppressed.

Figure 6B:
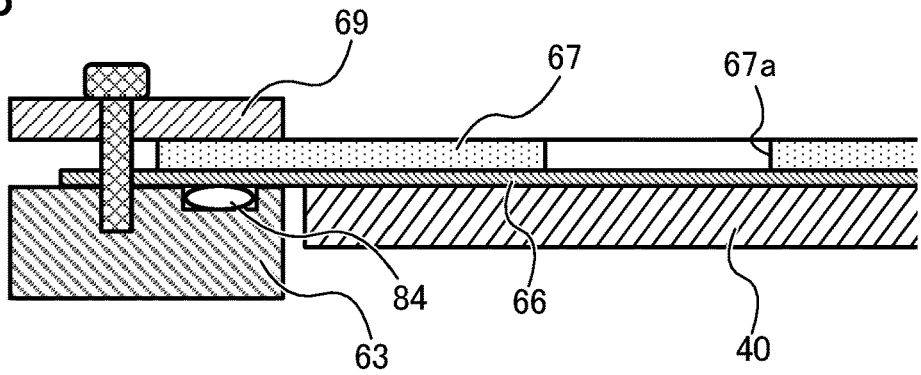
FIG. 6B is a view schematically showing another example of the mounting structure of the mask shown in FIG. 6A.

FIG. 6B is a view schematically showing another example of the mounting structure shown in FIG. 6A. An example shown in FIG. 6B is different from the example shown in FIG. 6A in that instead of closely connecting the diaphragm 66 and the mask 67 via the closely connecting layer 100, the diaphragm 66 is pressed onto and fixed to the mask 67 by the anode 40, and the example is the same as the example shown in FIG. 6A in the other respects. In the example shown in FIG. 6B, the diaphragm 66 is pressed onto and fixed to the mask 67 from the inner space 61 side by the anode 40. In other words, the diaphragm 66 is sandwiched between and supported by the mask 67 and the anode 40 in a region that covers the opening 63*a* of the holder base 62. Also, according to this configuration, an effect similar to that of FIG. 6B can be exhibited. Additionally, the example shown in FIG. 6B does not include the closely connecting layer 100, but the present invention is not limited to this example, and the diaphragm 66 may be sandwiched between and supported by the mask 67 and the anode 40, and closely connected to the mask 67 via the closely connecting layer 100. Also, in an example of a mounting structure in which the diaphragm 66 and the mask 67 are closely connected via the closely connecting layer 100 as shown in FIGS. 7 to 9 below, the diaphragm 66 may be sandwiched and fixed between the mask 67 and the anode 40 in place of or in addition to the closely connecting layer 100.

Figure 7:
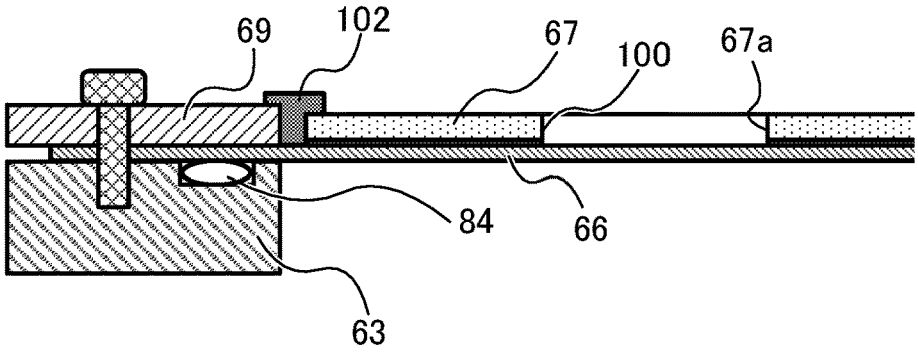
FIG. 7 is a view schematically showing a mounting structure of a diaphragm and a mask according to a first modification.

FIG. 7 is a view schematically showing a mounting structure of a diaphragm 66 and a mask 67 according to a first modification. In an example shown in FIG. 7, the diaphragm 66 is formed in a size larger than a size of an opening in a diaphragm retainer 69, and the mask 67 is formed in a size smaller than the size of the opening in the diaphragm retainer 69. Then, the diaphragm 66 is sandwiched between and supported by the diaphragm retainer 69 and a holder base cover 63, and the mask 67 is fixed to a front surface (upper side in FIG. 7) of the diaphragm 66 to be indirectly supported via the diaphragm 66. Here, in the case of adopting a configuration shown in FIG. 7, it is presumed that a gap is generated between an outer peripheral end of the mask 67 and the diaphragm retainer 69, and hence a sealing member 102 may be disposed to seal the gap. According to this configuration, it is possible to tightly close between the anode holder 60 and the diaphragm 66 more securely.

Figure 8:
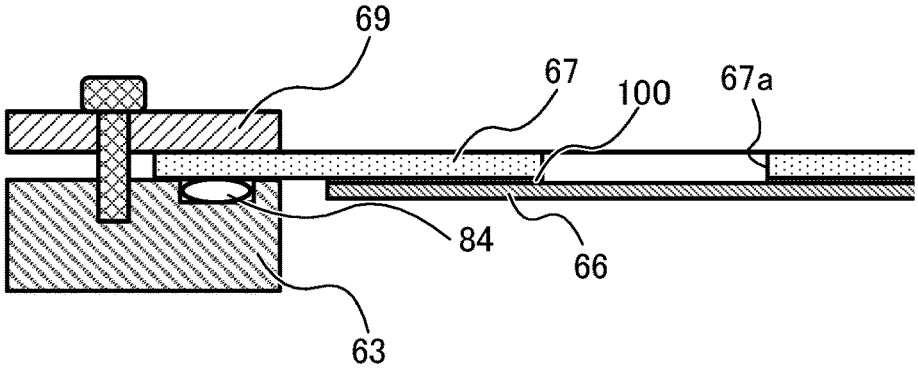
FIG. 8 is a view schematically showing a mounting structure of a diaphragm and a mask according to a second modification.

FIG. 8 is a view schematically showing a mounting structure of a diaphragm 66 and a mask 67 according to a second modification. In an example shown in FIG. 8, the diaphragm 66 is formed in a size smaller than a size of an opening in a diaphragm retainer 69, and the mask 67 is formed in a size larger than the size of the opening in the diaphragm retainer 69. Then, the mask 67 is sandwiched between and supported by the diaphragm retainer 69 and a holder base cover 63, and the diaphragm 66 is fixed to a back surface (lower side in FIG. 8) of the mask 67 to be indirectly supported via the mask 67. According to this configuration, the mask 67 can be physically sandwiched between and firmly supported by the diaphragm 66 and the diaphragm retainer 69.

Figure 9:
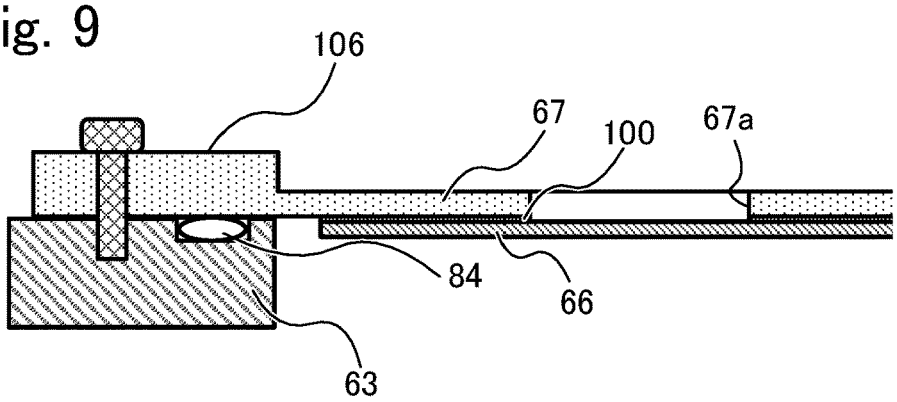
FIG. 9 is a view schematically showing a mounting structure of a diaphragm and a mask according to a third modification.

FIG. 9 is a view schematically showing a mounting structure of a diaphragm 66 and a mask 67 according to a third modification. In an example shown in FIG. 9, the mounting structure is the same as that shown in FIG. 8 except that a diaphragm retainer 69 is not provided and the mask 67 is directly fixed to a holder base cover 63. In the example shown in FIG. 9, the diaphragm 66 is formed in a size smaller than a size of an opening in the holder base cover 63, and the mask 67 is formed in a size larger than the size of the opening in the holder base cover 63. Also, the mask 67 includes a thick portion 106 with a large thickness around an outer peripheral edge, and has the thick portion 106 fixed to the holder base cover 63 with a screw. The diaphragm 66 is fixed to a back surface (lower side in FIG. 9) of the mask 67 to be indirectly supported via the mask 67. Thus, the thick portion 106 is provided, so that rigidity around the outer peripheral edge can be increased, and the mask 67 can be inhibited from being deformed, for example, in the case of heat welding of the diaphragm 66 and the mask 67. Note that the thick portion 106 of the mask 67 is formed thickly to protrude on a side (upper side in FIG. 9) opposite to a surface (lower side in FIG. 9) of the mask that is fixed to the diaphragm 66.

Figure 10:
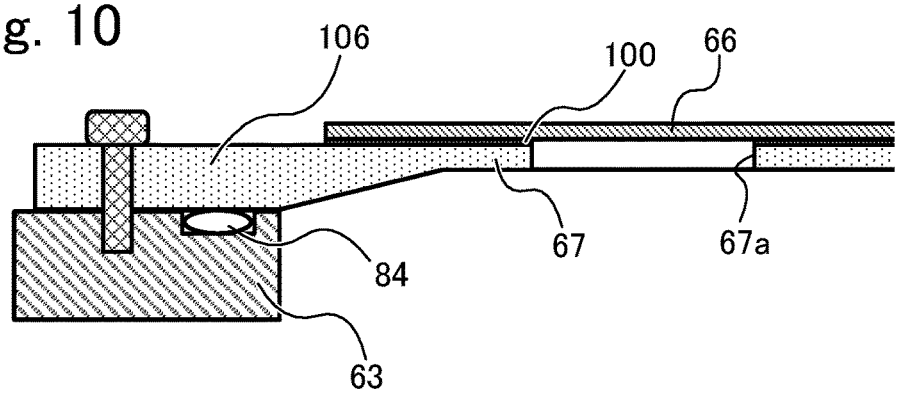
FIG. 10 is a view schematically showing a mounting structure of a diaphragm and a mask according to a fourth modification.

FIG. 10 is a view schematically showing a mounting structure of a diaphragm 66 and a mask 67 according to a fourth modification. In an example shown in FIG. 10, similarly to the example shown in FIG. 9, a diaphragm retainer 69 is not provided, and the mask 67 is directly fixed to a holder base cover 63. In the example shown in FIG. 10, the diaphragm 66 is formed in a size smaller than a size of an opening in the holder base cover 63, and the mask 67 is formed in a size larger than the size of the opening in the holder base cover 63. Also, the mask 67 includes a thick portion 106 with a large thickness around an outer peripheral edge, and has the thick portion 106 fixed to the holder base cover 63 with a screw. The diaphragm 66 is fixed to a front surface (upper side in FIG. 10) of the mask 67 to be indirectly supported via the mask 67. Note that in the example shown in FIG. 10, the thick portion 106 of the mask 67 is formed thickly to protrude on a side (lower side in FIG. 10) opposite to a surface (upper side in FIG. 10) of the mask that is fixed to the diaphragm 66. Thus, the thick portion 106 is provided, so that rigidity around the outer peripheral edge can be increased, and the mask 67 can be inhibited from being deformed, for example, in the case of heat welding of the diaphragm 66 and the mask 67. Further, the thick portion 106 is formed to protrude rearward, so that a volume of an inner space 61 can be increased. Also, the thick portion 106 has an inner peripheral edge tapered to be smoothly continuous with a region to which the diaphragm 66 is fixed. This can prevent oxygen generated in the inner space 61 from staying in the inner space 61, and oxygen can be smoothly exhausted from an air outlet 81. Further, the mask 67 is located behind (on an inner space 61 side of) the diaphragm 66 as shown in FIG. 10, so that it is possible to reduce the possibility that the fixed diaphragm 66 and mask 67 peel off, when a plating solution in a plating solution storage tank 52 is stirred with a paddle 16. Note that in the example shown in FIG. 10, the diaphragm 66 is formed in the size smaller than the size of the opening in the holder base cover 63, but may be formed in a size larger than the size of the opening in the holder base cover 63.

Figure 11:
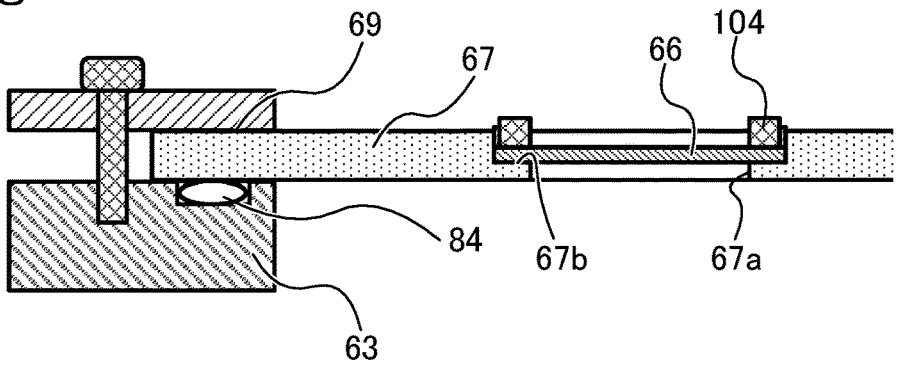
FIG. 11 is a view schematically showing a mounting structure of a diaphragm and a mask according to a fifth modification.

FIG. 11 is a view schematically showing a mounting structure of a diaphragm 66 and a mask 67 according to a fifth modification. In an example shown in FIG. 11, the mask 67 is formed in a size larger than a size of an opening in a diaphragm retainer 69, and sandwiched between the diaphragm retainer 69 and a holder base cover 63 to support the mask 67. On the other hand, in the example shown in FIG. 11, a plurality of diaphragms 66 are provided in a shape corresponding to each of a plurality of holes 67*a* of the mask 67. Then, the plurality of diaphragms 66 are fixed to the mask 67 to cover each of the plurality of holes 67*a* of the mask 67, and are accordingly indirectly supported via the mask 67. Here, in the example shown in FIG. 11, the plurality of holes 67*a* in the mask 67 include stepped portions 67*b* each formed in a size smaller than a size of the diaphragm 66, and the diaphragms 66 are fixed to the stepped portions 67*b*, respectively, to fix the diaphragms 66 and the mask 67. Further, as show in in FIG. 11, to more securely seal the mask 67 and each diaphragm 66, a circular sealing member 104 to be bonded or welded to at least one of the mask 67 and the diaphragm 66 may be provided. In this case, the diaphragm 66 and the mask 67 may be closely connected to each other via a closely connecting layer 100, or may be fixed to each other via no closely connecting layer 100 and via the sealing member 104. Also, in this case, a region where the diaphragm 66 is in contact with a plating solution can be reduced, and consumption of an additive can be reduced.

Figure 12:
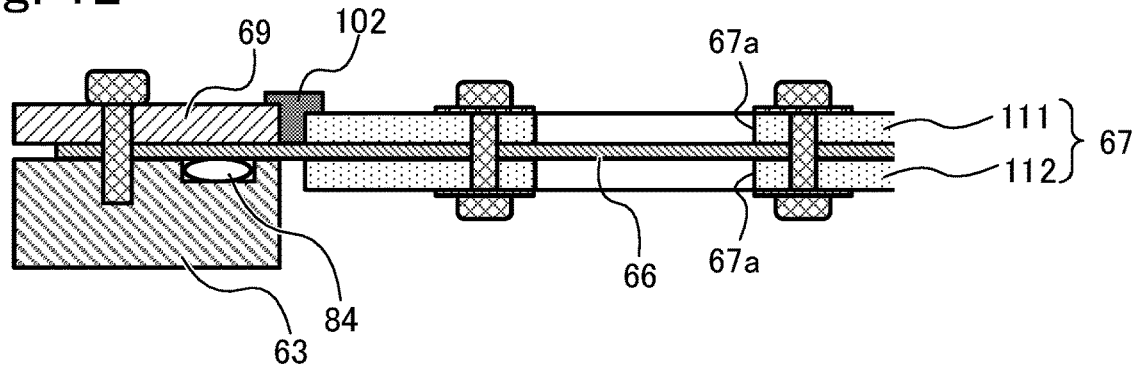
FIG. 12 is a view schematically showing a mounting structure of a diaphragm and a mask according to a sixth modification.

FIG. 12 is a view schematically showing a mounting structure of a diaphragm 66 and a mask 67 according to a sixth modification. The mounting structure shown in FIG. 12 is the same as the mounting structure shown in FIG. 7 except a fixing method of the diaphragm 66 and the mask 67. In the example shown in FIG. 12, the mask 67 and the diaphragm 66 are fixed to each other with a screw via no closely connecting layer 100. Here, the mask 67 and the diaphragm 66 are fixed with the screw in openings in a holder base cover 63 and a diaphragm retainer 69. In other words, the diaphragm 66 and the mask 67 are not fixed to each other in a region (first region) to be sandwiched between the holder base cover (base body) 63 and the diaphragm retainer 69, but are fixed to each other in a region (second region) that is not supported by the holder base cover 63 and the diaphragm retainer 69. However, the diaphragm 66 and the mask 67 are not limited to those fixed to each other only in the second region, and may be fixed to each other in the first region. Specifically, in the example shown in FIG. 12, the mask 67 includes a first mask member 111 disposed in front of (on an upper side in FIG. 12) the diaphragm 66, and a second mask member 112 disposed behind (on a lower side in FIG. 12) the diaphragm 66. Then, the first mask member 111 and the second mask member 112 between which the diaphragm 66 is sandwiched are fixed with a screw, to fix the mask 67 and the diaphragm 66. Also, in this example, a region where the diaphragm 66 is in contact with a plating solution can be reduced, and consumption of an additive can be reduced in the same manner as in the other examples.

Next, description will be made as to a specific example of the fixing of the diaphragm 66 and the mask 67. Each of FIGS. 13 to 21 is a view schematically showing a fixed part between the diaphragm 66 and the mask 67, and shows, with hatching, a region where the diaphragm 66 and the mask 67 are non-removably fixed. Note that in examples shown in FIGS. 13 to 21, the diaphragm 66 and the mask 67 are non-removably fixed to each other in a partial region, but part of the diaphragm 66 may only be fixed to the mask 67 in a region that covers a front surface of an inner space 61, that is, a region that covers an opening 63*a* of a holder base cover 63, or the diaphragm and the mask may be non-removably fixed to each other in the whole region. In addition, when non-removably fixing the diaphragm 66 and the mask 67, welding, bonding or the like may be used as described above. Further, in the examples shown in FIGS. 13 to 21, a plurality of holes 67*a* of the mask 67 are provided at equal intervals in each of a first alignment direction (up-down direction in the drawing) and a second alignment direction (right-left direction in the drawing). Further, in FIGS. 13 to 21, the up-down direction in the drawing is the same as the up-down direction (vertical direction) in FIG. 1, but the present invention is not limited to this example, and the direction may be tilted from the up-down direction (vertical direction) in FIG. 1. Further, in FIGS. 13 to 21, for ease of description, the diaphragm 66 and the mask 67 have the same outer shape size, but the present invention is not limited to this example.

FIGS. 13 to 16 show a non-removable fixed part between the diaphragm 66 and the mask 67 according to first to fourth examples. In the first to fourth examples, outer peripheral edges of the diaphragm 66 and the mask 67 are not directly fixed, and the diaphragm and the mask are non-removably fixed to each other in a partial region of an inner peripheral region. It is considered that these examples are especially effective in such a configuration as shown in FIG. 6 where the outer peripheral edges of both the diaphragm 66 and the mask 67 are sandwiched between and supported by the holder base cover 63 and the diaphragm retainer 69.

Figure 13:
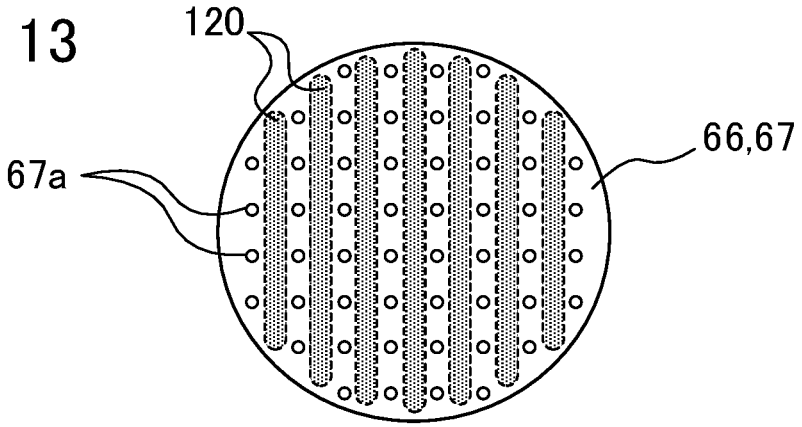
FIG. 13 shows a fixed part between a diaphragm and a mask according to a first example.

Specifically, in the first example shown in FIG. 13, the diaphragm 66 and the mask 67 are non-removably closely connected in a plurality of closely connecting regions 120 along the first alignment direction (up-down direction in FIG. 13) of the plurality of holes 67*a*. Note that in the example shown in FIG. 13, the holes 67*a* and the closely connecting regions 120 are alternately arranged in the second alignment direction (right-left direction in the drawing), but the present invention is not limited to this example. For example, each closely connecting region 120 along the first alignment direction may be provided for every two or more holes 67*a* in the second alignment direction. Note that in the first example shown in FIG. 13, each closely connecting region 120 may have a long shape in a vertical or horizontal direction as the first alignment direction, or a long shape tilted in the vertical or horizontal direction.

Figure 14:
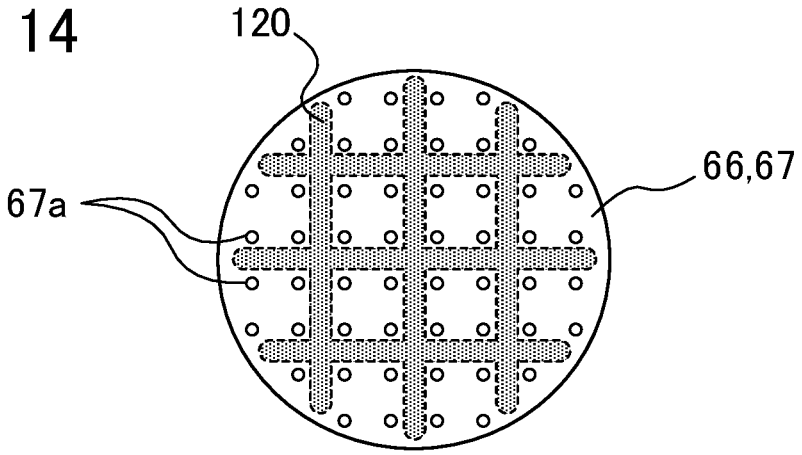
FIG. 14 shows a fixed part between a diaphragm and a mask according to a second example.

In the second example shown in FIG. 14, the diaphragm 66 and the mask 67 are non-removably closely connected in a lattice-shaped closely connecting region 120 along each of the first alignment direction (up-down direction in FIG. 14) and the second alignment direction (right-left direction in FIG. 14) of the plurality of holes 67*a*. Note that in the example shown in FIG. 14, each closely connecting region 120 is disposed for every two holes 67*a* in each of the first alignment direction and the second alignment direction, but the present invention is not limited to this example. For example, the closely connecting region 120 may be provided for each hole 67*a* or every three or more holes 67*a* in the first alignment direction or the second alignment direction. Furthermore, the closely connecting regions 120 may be provided at intervals that are different between the first alignment direction and the second alignment direction.

Figure 15:
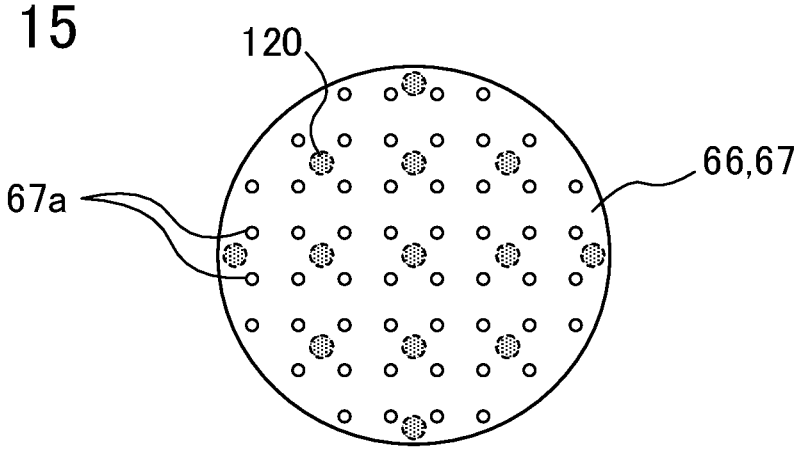
FIG. 15 shows a fixed part between a diaphragm and a mask according to a third example.

In the third example shown in FIG. 15, the diaphragm 66 and the mask 67 are non-removably closely connected in a closely connecting region 120 including a plurality of small regions. In other words, the diaphragm 66 and the mask 67 are closely connected to a plurality of small closely connecting points. Note that in the example shown in FIG. 15, the closely connecting region 120 is disposed for every two holes 67*a* in each of the first alignment direction and the second alignment direction, but the present invention is not limited to this example. For example, the closely connecting region 120 may be provided for each hole 67*a* or every three or more holes 67*a* in the first alignment direction or the second alignment direction. Furthermore, the closely connecting regions 120 may be provided at intervals that are different between the first alignment direction and the second alignment direction.

Figure 16:
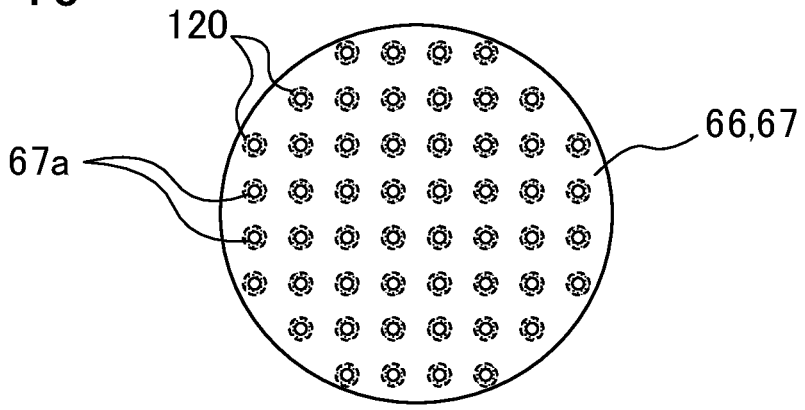
FIG. 16 shows a fixed part between a diaphragm and a mask according to a fourth example.

In the fourth example shown in FIG. 16, the diaphragm 66 and the mask 67 are non-removably closely connected in edge portions of the plurality of holes 67*a*. Note that in the example shown in FIG. 16, the edge portions of all the plurality of holes 67*a* are formed as closely connecting regions 120, but the edge portions of some holes 67*a* of the plurality of holes 67*a* may be formed as the closely connecting regions 120.

FIGS. 17 to 21 show a fixed part between the diaphragm 66 and the mask 67 according to fifth to ninth examples. In the fifth to ninth examples, outer peripheral edges of the diaphragm 66 and the mask 67 are non-removably closely connected by closely connecting regions 120. It is considered that these examples are especially effective in configurations shown in FIGS. 7 to 10 where the outer peripheral edge of at least one of the diaphragm 66 and the mask 67 is not sandwiched between the holder base cover 63 and the diaphragm retainer 69.

Figure 17:
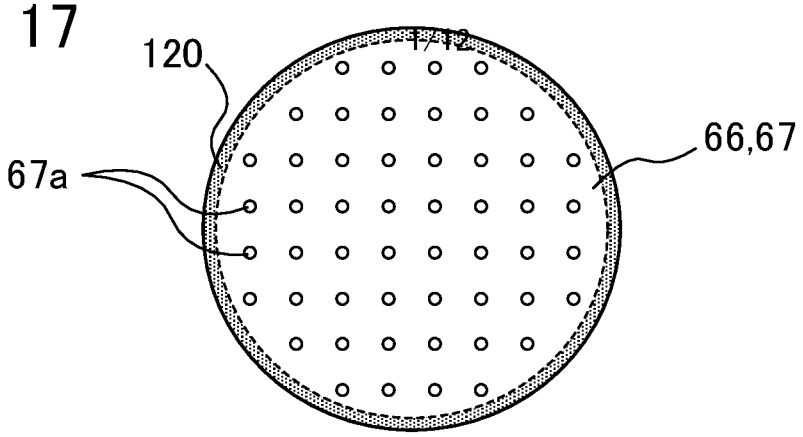
FIG. 17 shows a fixed part between a diaphragm and a mask according to a fifth example.
Figure 18:
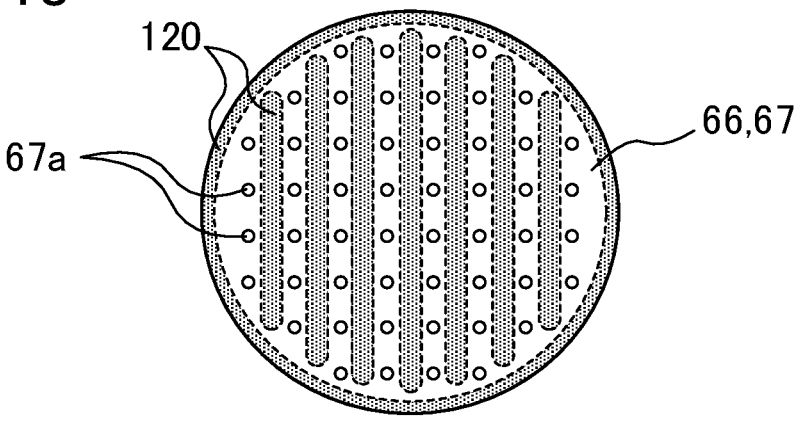
FIG. 18 shows a fixed part between a diaphragm and a mask according to a sixth example.
Figure 19:
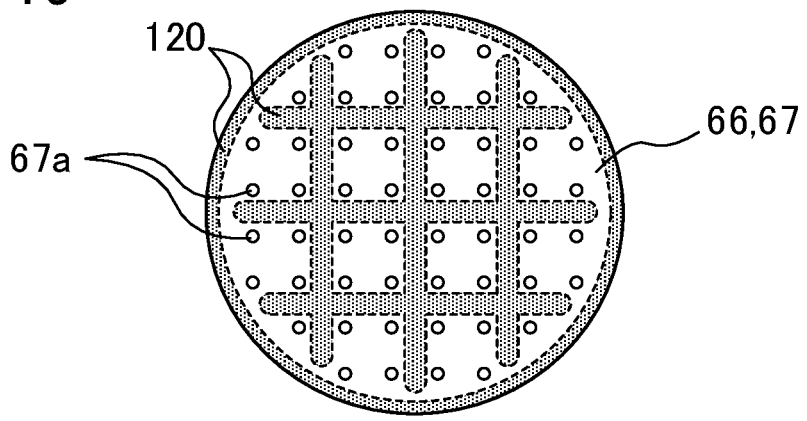
FIG. 19 shows a fixed part between a diaphragm and a mask according to a seventh example.
Figure 20:
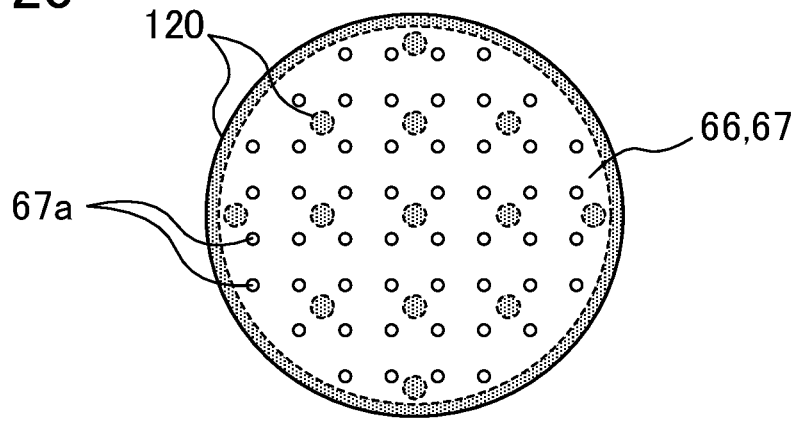
FIG. 20 shows a fixed part between a diaphragm and a mask according to an eighth example.
Figure 21:
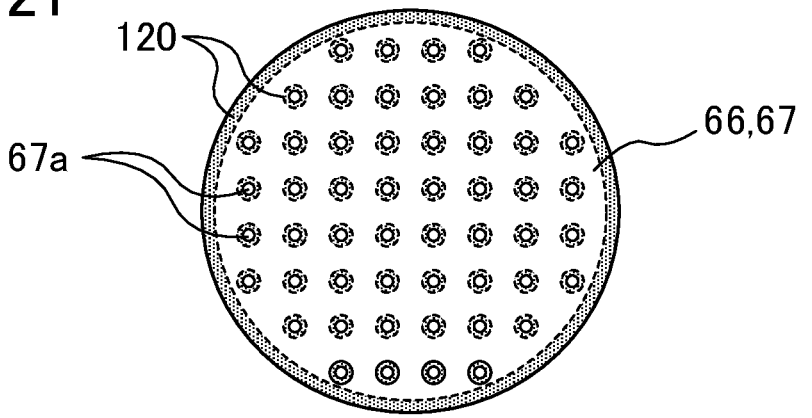
FIG. 21 shows a fixed part between a diaphragm and a mask according to a ninth example.

Specifically, in the fifth example shown in FIG. 17, the diaphragm 66 and the mask 67 are non-removably fixed in the outer peripheral edge of the diaphragm 66 or the mask 67, and are not directly fixed non-removably in an inner peripheral region. Furthermore, the sixth to ninth examples shown in FIGS. 18 to 21 are the same as the first to fourth examples shown in FIGS. 13 to 16 except that the diaphragm 66 and the mask 67 are non-removably fixed in the outer peripheral edge of the diaphragm or the mask. Redundant description with reference to FIGS. 18 to 21 will not be repeated.

Second Embodiment

Figure 22:
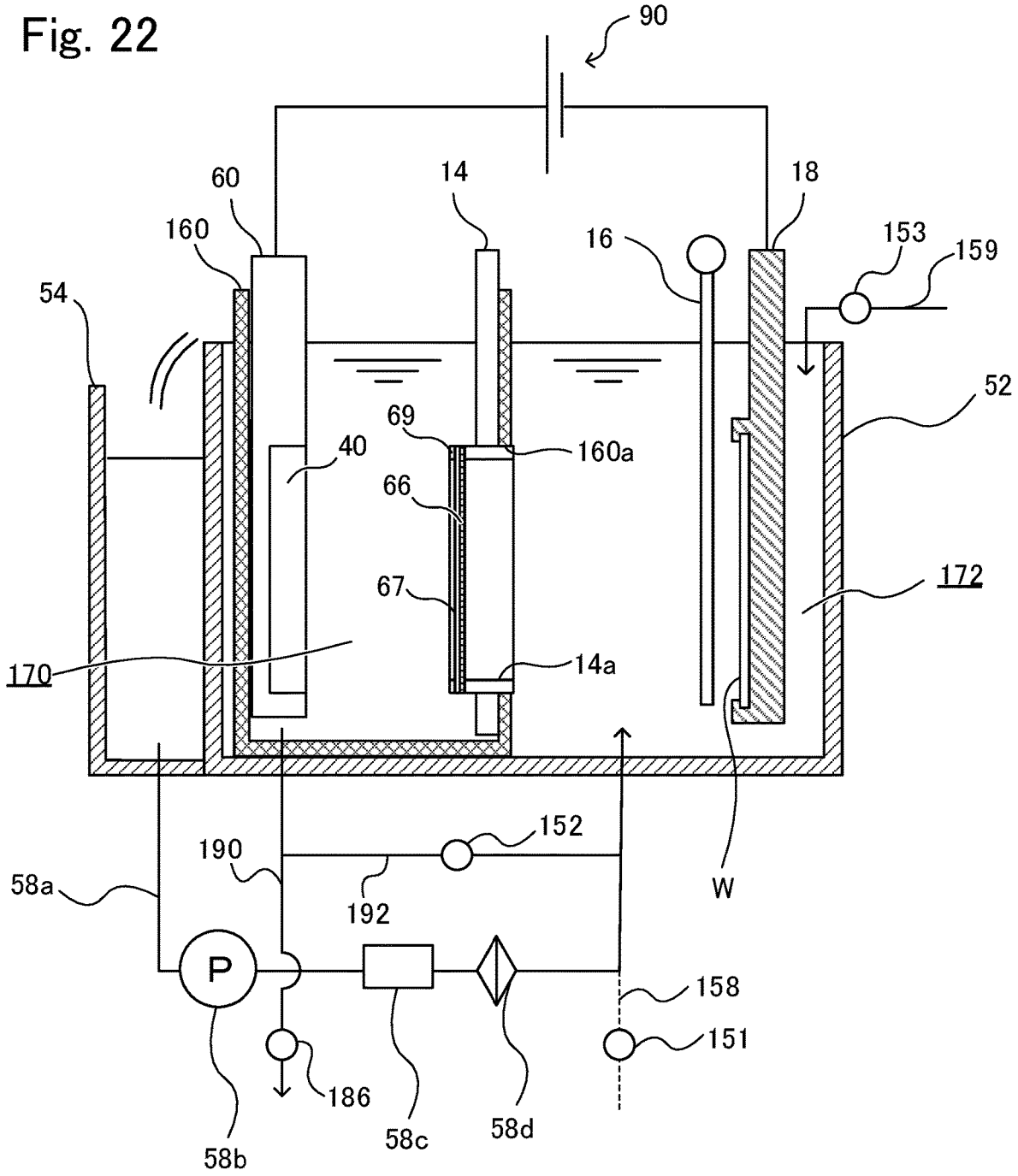
FIG. 22 is a schematic view showing a plating apparatus according to a second embodiment.

FIG. 22 is a schematic view showing a plating apparatus according to a second embodiment. The plating apparatus according to the second embodiment is different from the plating apparatus according to the first embodiment in that a diaphragm 66 and a mask 67 are not attached to an anode holder 60, but are mounted in an opening 14*a* in a regulation plate 14. In the following description, a description that overlaps with that of the first embodiment will not be repeated.

In the plating apparatus according to the second embodiment, a shield box 160 is disposed in a plating solution storage tank 52, and accordingly, an interior of the plating solution storage tank 52 is divided into an anode tank 170 inside the shield box 160 and a cathode tank 172 outside the shield box. In the example shown in FIG. 22, the anode holder 60 holding an anode 40 and the regulation plate 14 are arranged in the anode tank 170, and a paddle 16 and a substrate holder 18 (cathode) are arranged in the cathode tank 172.

The shield box 160 includes an opening 160*a* at a position corresponding to the opening 14*a* of the regulation plate 14. Also, a tubular part that defines the opening 14*a* of the regulation plate 14 is fitted into the opening 160*a* of the shield box 160. According to this configuration, the anode tank 170 communicates with the cathode tank 172 through the opening 14*a* of the regulation plate 14. Then, in the second embodiment, the diaphragm 66 and the mask 67 are mounted in the opening 14*a* of the regulation plate 14, and the anode tank 170 and the cathode tank 172 are divided by the diaphragm 66 and the mask 67. Alternatively, the diaphragm 66 and the mask 67 may be mounted from an anode tank 170 side in the regulation plate 14, or may be mounted from a cathode tank 172 side.

As an example, the diaphragm 66 and the mask 67 are mounted to the regulation plate 14 by use of an annular diaphragm retainer 69. Here, the diaphragm 66 and the mask 67 may be fixed in the regulation plate 14 in the same manner as in fixing the diaphragm 66 and the mask 67 in the anode holder 60 in the first embodiment. That is, as an example, the diaphragm 66 and the mask 67 may be mounted to the regulation plate 14 with a mounting structure in which the holder base cover 63 in the mounting structure shown in FIGS. 6 to 12 is replaced with the regulation plate 14. Also, the diaphragm 66 and the mask 67 may be fixed in the same manner as in the first embodiment.

In the plating apparatus of the second embodiment, a plating solution in the cathode tank 172 flows over a side wall of the plating solution storage tank 52 to flow into an overflow tank 54. On the other hand, the plating solution in the anode tank 170 is configured not to overflow. Further, a liquid discharge line 190 in which an on-off valve 186 is disposed is connected to the anode tank 170. For example, in a case where a soluble anode is used as an anode 40, a black film generated in the anode tank 170 can be discharged to outside through the liquid discharge line 190. Therefore, according to the plating apparatus of the second embodiment, an amount of the black film to be included in the plating solution (base liquid) in the anode tank 170 can be decreased, and the black film floating in the plating solution can be substantially completely inhibited from entering the cathode tank 172.

Also, in the plating apparatus according to the second embodiment, a base liquid supply line 158 is connected to a plating solution circulation line 58*a*. The base liquid supply line 158 is not intended to supply the plating solution to the plating solution storage tank 52 during plating of a substrate W, but is used to first supply the base liquid to the plating solution storage tank 52 for performing plating, that is, used only for so-called initial make-up of an electrolytic bath. The base liquid supply line 158 is provided with a first supply valve 151. Also, in the plating apparatus of the second embodiment, a connection line 192 is disposed to connect the plating solution circulation line 58*a* and the liquid discharge line 190. The connection line 192 is provided with a second supply valve 152. Further, the plating apparatus of the second embodiment is provided with an additive supply line 159 for supplying an additive to the cathode tank 172. The additive supply line 159 is provided with a third supply valve 153. Usually, the first to third supply valves 151 to 153 are closed.

According to the plating apparatus of the second embodiment, the first supply valve 151 and the second supply valve 152 are opened only during the initial make-up of the electrolytic bath, and the base liquid from the base liquid supply line 158 is supplied through the liquid discharge line 190 and the plating solution circulation line 58*a* into the anode tank 170 and the cathode tank 172. Then, the third supply valve 153 is opened, to supply the additive only to the cathode tank 172. According to this configuration, the anode tank 170 does not store the additive, and hence consumption of the additive in the vicinity of the anode 40 can be reduced.

In the plating apparatus of the second embodiment described above, the plating solution storage tank 52 is divided into the anode tank 170 and the cathode tank 172 by the shield box 160 and the regulation plate 14. Then, the diaphragm 66 and the mask 67 including a plurality of holes and fixed to the diaphragm 66 are provided in the opening 14*a* of the regulation plate 14. According to this configuration, a region where the diaphragm 66 is in contact with the plating solution can be reduced, and the additive can be inhibited from reaching the anode 40 to reduce consumption of the additive, in the same manner as in the plating apparatus of the first embodiment.

Third Embodiment

Figure 23:
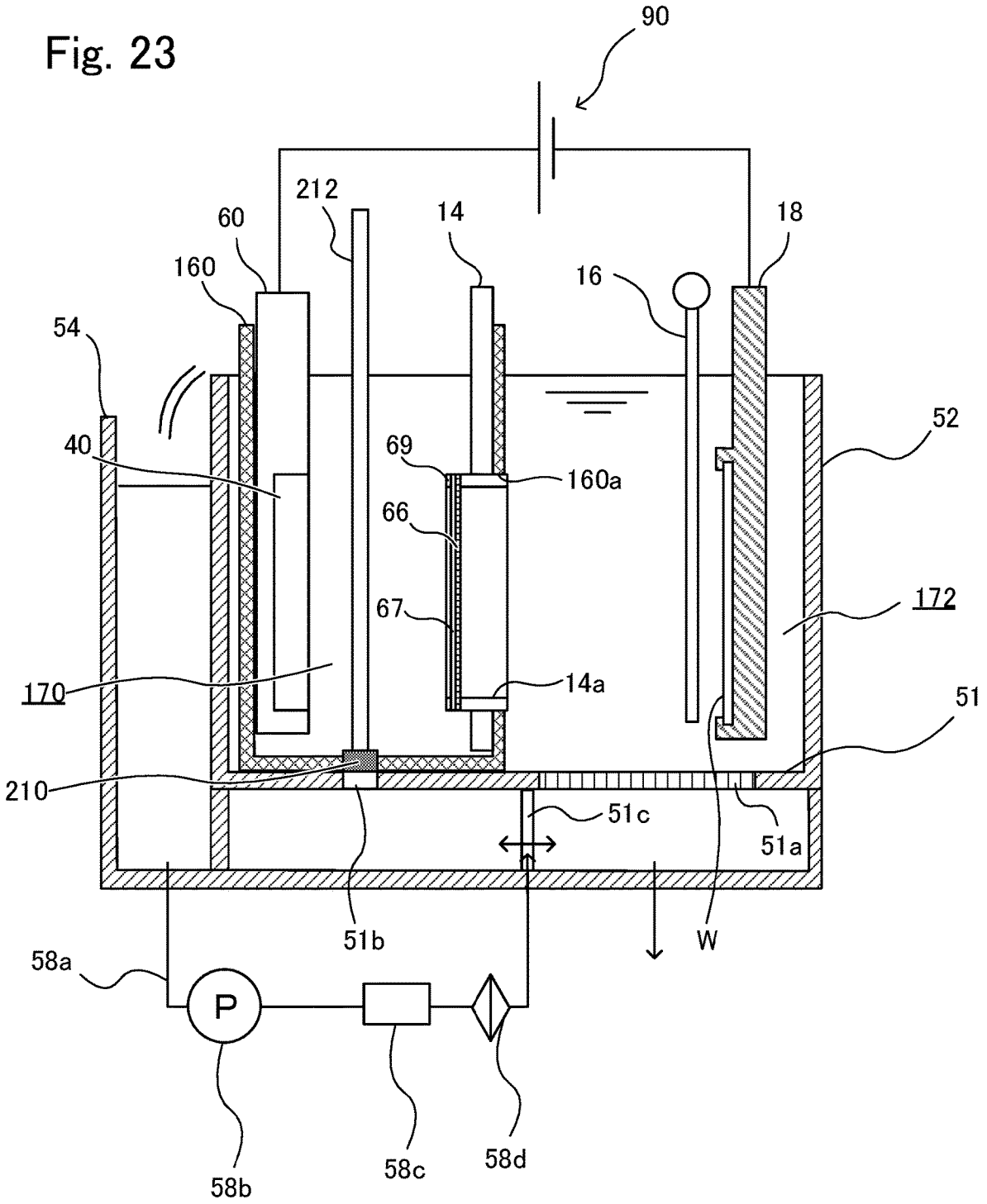
FIG. 23 is a schematic view showing a plating apparatus according to a third embodiment.

FIG. 23 is a schematic view showing a plating apparatus according to a third embodiment. The plating apparatus according to the third embodiment includes a shield box 160, and a diaphragm 66 and a mask 67 are mounted in an opening 14*a* in a regulation plate 14, in the same manner as in the second embodiment. The plating apparatus according to the third embodiment is different from the plating apparatus according to the second embodiment in a configuration concerning a plating solution storage tank 52 and the shield box 160, and is the same as the plating apparatus according to the second embodiment in the other respects. In the following description, a description that overlaps with that of the second embodiment will not be repeated.

In the plating apparatus according to the third embodiment, a bottom plate 51 is disposed in a plating solution storage tank 52, and an interior of the plating solution storage tank 52 is divided, by this bottom plate, into an upper substrate treatment chamber and a lower plating solution distributing chamber 53. The shield box 160 is disposed in the upper substrate treatment chamber. The substrate treatment chamber is divided into an anode tank 170 and a cathode tank 172 by the shield box 160.

The plating apparatus of the third embodiment is configured so that a plating solution in the cathode tank 172 can overflow to flow into an overflow tank 54 and the plating solution in the anode tank 170 does not overflow, in the same manner as in the plating apparatus of the second embodiment. One end of a plating solution circulation line 58*a* is connected to a bottom of the overflow tank 54, and the other end of the plating solution circulation line 58*a* is connected to a bottom of the plating solution distributing chamber 53.

A shielding plate 51*c* hanging downward to regulate flow of the plating solution is attached to the bottom plate 51 in the plating solution storage tank 52. Also, in the bottom plate 51, a first plating solution flow port 51*a* that communicates between the cathode tank 172 and the plating solution distributing chamber 53 is formed. Furthermore, a second plating solution flow port 51*b* located below the anode tank 170 is formed in the bottom plate 51. In a bottom of the shield box 160, a bottom opening is formed at a position corresponding to the second plating solution flow port 51*b*. The plating solution distributing chamber 53 communicates with the anode tank 170 through the second plating solution flow port 51*b* and the bottom opening of the shield box 160. The bottom opening of the shield box 160 is usually sealed with a plating solution plug 210. The plating solution plug 210 is connected to a plating solution unplugging stick 212 extending in an up-down direction to outside the shield box 160. The plating solution unplugging stick 212 moves in a vertical direction, to open and close an opening 160*b*. Here, the plating solution unplugging stick 212 may be manually operated, or may be operated by any power source such as a motor, a solenoid, or a pneumatic actuator.

In the plating apparatus of the third embodiment, the plating solution containing an additive is stored in the plating solution storage tank 52 during initial make-up of the electrolytic bath. Subsequently, the shield box 160 is placed in the plating solution in a state where the plating solution plug 210 is opened, and the anode tank 170 is filled with the plating solution. Then, the plating solution plug 210 is closed, to divide the anode tank 170 and the cathode tank 172.

Also, in the plating apparatus of the third embodiment, the substrate treatment chamber is divided into the anode tank 170 and the cathode tank 172 by the shield box 160 and the regulation plate 14. Then, the diaphragm 66 and the mask 67 including a plurality of holes and fixed to the diaphragm 66 are mounted in the opening 14*a* of the regulation plate 14. Consequently, a region where the diaphragm 66 is in contact with the plating solution can be reduced, and the additive in the cathode tank 172 can be inhibited from reaching an anode 40 to reduce consumption of the additive, in the same manner as in the plating apparatus of the first embodiment.

Note that in the first to third embodiments, the diaphragm 66 and the mask 67 are arranged to extend in a vertical direction of the plating apparatus (to orient plate surfaces in a horizontal direction), but the present invention is not limited to the examples. For example, the diaphragm 66 and the mask 67 may be arranged to extend in the horizontal direction of the plating apparatus (to orient the plate surfaces in the vertical direction).

The present embodiments described above can be described in aspects as follows.

[Aspect 1]

According to Aspect 1, an anode holder for holding an anode for use in a plating apparatus is provided. The anode holder includes an inner space formed in the anode holder, to house the anode, a mask including a plurality of holes, and configured to cover a front surface of the inner space, and a diaphragm, at least part of the diaphragm being fixed to the mask in a region of the mask that covers the front surface of the inner space. According to the anode holder of Aspect 1, the mask can reduce a region where the diaphragm is in contact with a plating solution, and can further inhibit an additive from reaching the anode to reduce consumption of the additive.

[Aspect 2]

According to Aspect 2, in Aspect 1, the diaphragm and the mask are closely connected to each other via a closely connecting layer.

[Aspect 3]

According to Aspect 3, in Aspect 1 or 2, the diaphragm and the mask are bonded or welded to each other.

[Aspect 4]

According to Aspect 4, an opening ratio by the plurality of holes is equal to or more than 2% and equal to or less than 25%.

Aspect 5

According to Aspect 5, in Aspects 1 to 4, the anode holder includes a base body supporting at least one of the diaphragm and the mask, and the diaphragm and the mask are fixed to each other in a second region that is different from a first region where the at least one of the diaphragm and the mask is supported by the base body. According to Aspect 5, the plating solution can be inhibited from entering a gap between the diaphragm and the mask, and the consumption of the additive can be further reduced.

[Aspect 6]

According to Aspect 6, in Aspects 1 to 5, the mask is fixed on a side of the inner space with respect to the diaphragm.

[Aspect 7]

According to Aspect 7, in Aspects 1 to 5, the mask is fixed on a side opposite to the inner space with respect to the diaphragm.

[Aspect 8]

According to Aspect 8, in Aspect 7, the diaphragm is sandwiched between the mask and the anode to be fixed to the mask.

[Aspect 9]

According to Aspect 9, in Aspects 1 to 8, each of the plurality of holes is tapered with a diameter increasing away from the diaphragm. According to Aspect 9, foreign matter can be inhibited from staying in the plurality of holes in the mask.

[Aspect 10]

According to Aspect 10, in Aspects 1 to 9, the diaphragm and the mask are arranged to extend in a vertical direction of the plating apparatus.

[Aspect 11]

According to Aspect 11, in Aspects 1 to 10, the mask is made of a resin.

[Aspect 12]

According to Aspect 12, in Aspects 1 to 11, the diaphragm is an ion exchange membrane or a neutral diaphragm.

[Aspect 13]

According to Aspect 13, a plating apparatus is provided. The plating apparatus includes a plating solution tank, a mask including a plurality of holes, and dividing the plating solution tank into an anode tank in which an anode is disposed and a cathode tank in which a cathode is disposed, and a diaphragm, at least part of the diaphragm being fixed to the mask in a region of the mask that covers a front surface of an inner space. According to the plating apparatus of Aspect 13, the mask can reduce a region where the diaphragm is in contact with a plating solution, and can further inhibit an additive from reaching the anode to reduce consumption of the additive.

The embodiments of the present invention have been described above based on several examples, but the above embodiments of the present invention are described to facilitate understanding of the present invention, and do not limit the present invention. The present invention may be changed or modified without departing from the scope, and needless to say, the present invention includes equivalents to the invention. Also, in a range in which at least some of the above-described problems can be solved or a range in which at least some of effects are exhibited, any arbitrary combination or omission of respective constituent components described in claims and description is possible.

The present application is based on and claims the benefit of priority of Japanese Patent Application No. 2019-107724 filed on Jun. 10, 2019. All disclosed contents including the description, claims, drawings and abstract of Japanese Patent Application No. 2019-107724 are entirely incorporated herein by reference. All disclosure including the description, claims, drawings and abstract of each of Japanese Patent No. 2510422 (PTL 1) and Japanese Patent Laid-Open No. 2009-155726 (PTL 2) is entirely incorporated herein by reference.

REFERENCE SIGNS LIST

14 regulation plate
14*a* opening
16 paddle
18 substrate holder
40 anode
50 plating solution tank
52 plating solution storage tank
54 overflow tank
60 anode holder
61 inner space

62 holder base
63 holder base cover
66 diaphragm
67 mask
67*a* hole
68 outer edge mask
69 diaphragm retainer
100 closely connecting layer
102 sealing member
104 sealing member
106 thick portion
108 shield box
111 first mask member
112 second mask member
120 closely connecting region
160 shield box
170 anode tank
172 cathode tank

The invention claimed is:

1. An anode holder for holding an insoluble anode for use in a plating apparatus, the anode holder comprising:

an inner space formed in the anode holder, to house the insoluble anode;

a mask comprising a plate-shaped member including a plurality of holes, and configured to cover a front surface of the inner space; and a diaphragm, at least part of the diaphragm being fixed to the mask in a region of the mask that covers the front surface of the inner space, wherein the inner space and an outer space of the anode holder are divided by the diaphragm and the mask, the mask is fixed on a side opposite to the inner space with respect to the diaphragm, and the diaphragm is sandwiched between the mask and the insoluble anode to be fixed to the mask, and is placed in direct physical contact with the insoluble anode.

2. The anode holder according to claim 1, wherein the diaphragm and the mask are closely connected to each other via a closely connecting layer.

3. The anode holder according to claim 1, wherein the diaphragm and the mask are bonded or welded to each other.

4. The anode holder according to claim 1, wherein an opening ratio by the plurality of holes is equal to or more than 2% and equal to or less than 25%.

5. The anode holder according to claim 1, further comprising a base body supporting at least one of the diaphragm and the mask, wherein the diaphragm and the mask are fixed to each other in a second region that is different from a first region where the at least one of the diaphragm and the mask is supported by the base body.

6. The anode holder according to claim 1, wherein each of the plurality of holes is tapered with a diameter increasing away from the diaphragm.

7. The anode holder according to claim 1, wherein the diaphragm and the mask are arranged to extend in a vertical direction of the plating apparatus.

8. The anode holder according to claim 1, wherein the mask is made of a resin.

9. The anode holder according to claim 1, wherein the diaphragm is an ion exchange membrane or a neutral diaphragm.

10. A plating apparatus comprising:

a plating solution tank;

a mask comprising a plate-shaped member including a plurality of holes, and dividing the plating solution tank into an anode tank in which an insoluble anode is disposed and a cathode tank in which a cathode is disposed; and a diaphragm, at least part of the diaphragm being fixed to the mask in a region of the mask that covers a front surface of the anode tank, wherein the anode tank and the cathode tank are divided by the diaphragm and the mask, the mask is fixed on a side of the cathode tank with respect to the diaphragm, and the diaphragm is sandwiched between the mask and the insoluble anode to be fixed to the mask, and is placed in direct physical contact with the insoluble anode.

* * * * *